US010472705B2

(12) United States Patent
Damm et al.

(10) Patent No.: US 10,472,705 B2
(45) Date of Patent: Nov. 12, 2019

(54) COLD WORK TOOL STEEL

(71) Applicant: Uddeholms AB, Hagfors (SE)

(72) Inventors: Petter Damm, Karlstad (SE); Thomas Hillskog, Karlstad (SE); Kjell Bengtsson, Råda (SE); Annika Engström Svensson, Filipstad (SE); Sebastian Ejnermark, Hammarö (SE); Lars Ekman, Ekshärad (SE); Victoria Bergqvist, Ekshärad (SE)

(73) Assignee: UDDEHOLMS AB, Hagfors (SE)

( * ) Notice: Subject to any disclaimer, the term of this patent is extended or adjusted under 35 U.S.C. 154(b) by 160 days.

(21) Appl. No.: 15/324,560

(22) PCT Filed: Jun. 26, 2015

(86) PCT No.: PCT/SE2015/050751

§ 371 (c)(1),
(2) Date: Jan. 6, 2017

(87) PCT Pub. No.: WO2016/010469

PCT Pub. Date: Jan. 21, 2016

(65) Prior Publication Data

US 2017/0233854 A1 Aug. 17, 2017

(30) Foreign Application Priority Data

Jul. 16, 2014 (EP) ..... 14177221

(51) Int. Cl.
*C22C 38/00* (2006.01)
*C22C 38/02* (2006.01)
(Continued)

(52) U.S. Cl.
CPC ..... *C22C 38/46* (2013.01); *C21D 6/002* (2013.01); *C21D 6/02* (2013.01); *C22C 33/0278* (2013.01);
(Continued)

(58) Field of Classification Search
CPC ..... C22C 38/001; C22C 38/02; C22C 38/04; C22C 38/22; C22C 38/24; C22C 38/44; C22C 38/46; C21D 6/002; C21D 6/02
See application file for complete search history.

(56) References Cited

U.S. PATENT DOCUMENTS 4,140,527 A 2/1979 Kawai et al.
4,936,911 A 6/1990 Roberts et al.
(Continued)

FOREIGN PATENT DOCUMENTS

CN 1355855 A 6/2002
CN 101248204 A 8/2008
(Continued)

OTHER PUBLICATIONS

Chinese Office Action dated Dec. 5, 2017, for Chinese Patent Application No. 201580037760.2.
(Continued)

*Primary Examiner* — Cam N. Nguyen
(74) *Attorney, Agent, or Firm* — Karceski IP Law, PLLC

(57) ABSTRACT

The invention relates to a cold work tool steel. The steel comprises the following main components (in wt. %): C 0.5-2, N 1.3-3, Si 0.05-1.2, Mn 0.05-1, Cr 2.5-5.5, Mo 0.8-2.2, V 6-18, with a balance of optional elements, iron, and impurities.

12 Claims, 2 Drawing Sheets

Microstructure of the inventive steel. Small and uniformly distributed MX-particles (black phase) in the steel matrix.

(51) Int. Cl.

| | |
|---|---|
| ***C22C 38/04*** | (2006.01) |
| ***C22C 38/22*** | (2006.01) |
| ***C22C 38/24*** | (2006.01) |
| ***C22C 38/44*** | (2006.01) |
| ***C22C 38/46*** | (2006.01) |
| ***C21D 6/00*** | (2006.01) |
| ***C21D 6/02*** | (2006.01) |
| ***C22C 33/02*** | (2006.01) |

(52) U.S. Cl.

CPC ..... *C22C 38/001* (2013.01); *C22C 38/02* (2013.01); *C22C 38/04* (2013.01); *C22C 38/22* (2013.01); *C22C 38/24* (2013.01); *C22C 38/44* (2013.01); *B22F 2998/10* (2013.01); *B22F 2999/00* (2013.01); *C21D 2211/004* (2013.01)

(56) References Cited

U.S. PATENT DOCUMENTS

| | | | | |
|---|---|---|---|---|
| 5,435,827 | A | 7/1995 | Wisell | |
| 6,162,275 | A | 12/2000 | Jonsson et al. | |
| 6,818,040 | B1 | 11/2004 | Sandberg et al. | |
| 10,041,158 | B2 * | 8/2018 | Tanaka | C21D 6/005 |
| 10,047,416 | B2 * | 8/2018 | Kami | C22C 38/58 |
| 10,047,419 | B2 * | 8/2018 | Ivarsson | C22C 38/20 |
| 10,053,763 | B2 * | 8/2018 | Trivedi | C23C 8/58 |
| 10,060,006 | B2 * | 8/2018 | Suwa | C22C 38/001 |
| 10,066,283 | B2 * | 9/2018 | Toda | C23C 2/02 |
| 10,072,323 | B2 * | 9/2018 | Teraoka | C22C 38/54 |
| 10,072,324 | B2 * | 9/2018 | Nonaka | C22C 38/26 |
| 2013/0084462 | A1 | 4/2013 | Theisen et al. | |

FOREIGN PATENT DOCUMENTS

| | | | |
|---|---|---|---|
| DE | 4231695 | A1 | 3/1994 |
| EP | 0230576 | A1 | 8/1987 |
| TW | 201029776 | A | 8/2010 |
| WO | 8807093 | A1 | 9/1988 |
| WO | 9302819 | | 2/1993 |
| WO | 0079015 | A1 | 12/2000 |
| WO | WO 0079015 | A1 | 12/2000 |
| WO | WO 2007024192 | A1 | 3/2007 |
| WO | 2007120110 | A1 | 10/2007 |
| WO | 2010044740 | A1 | 4/2010 |

OTHER PUBLICATIONS

International Search Report dated Nov. 9, 2015, for International Patent Application No. PCT/SE2015/050751.

Extended European Search Report dated May 31, 2017, for European Patent Application No. 15821258.9.

Chinese Office Action dated Jul. 6, 2018, for Chinese Patent Application No. 201580037760.2.

Taiwanese Office Action dated Aug. 30, 2018, for Taiwanese Patent Application No. 104121457.

European Communication dated Jan. 3, 2019, for European Patent Application No. 15821258.9.

Japanese Office Action dated Feb. 19, 2019, for Japanese Patent Application No. 2017-502158.

Chinese Office Action dated Jun. 25, 2019, for Chinese Application No. 201580037760.2.

Brazilian Office Action dated Aug. 27, 2019, for Brazilian Patent Application No. BR112017000078-4.

* cited by examiner

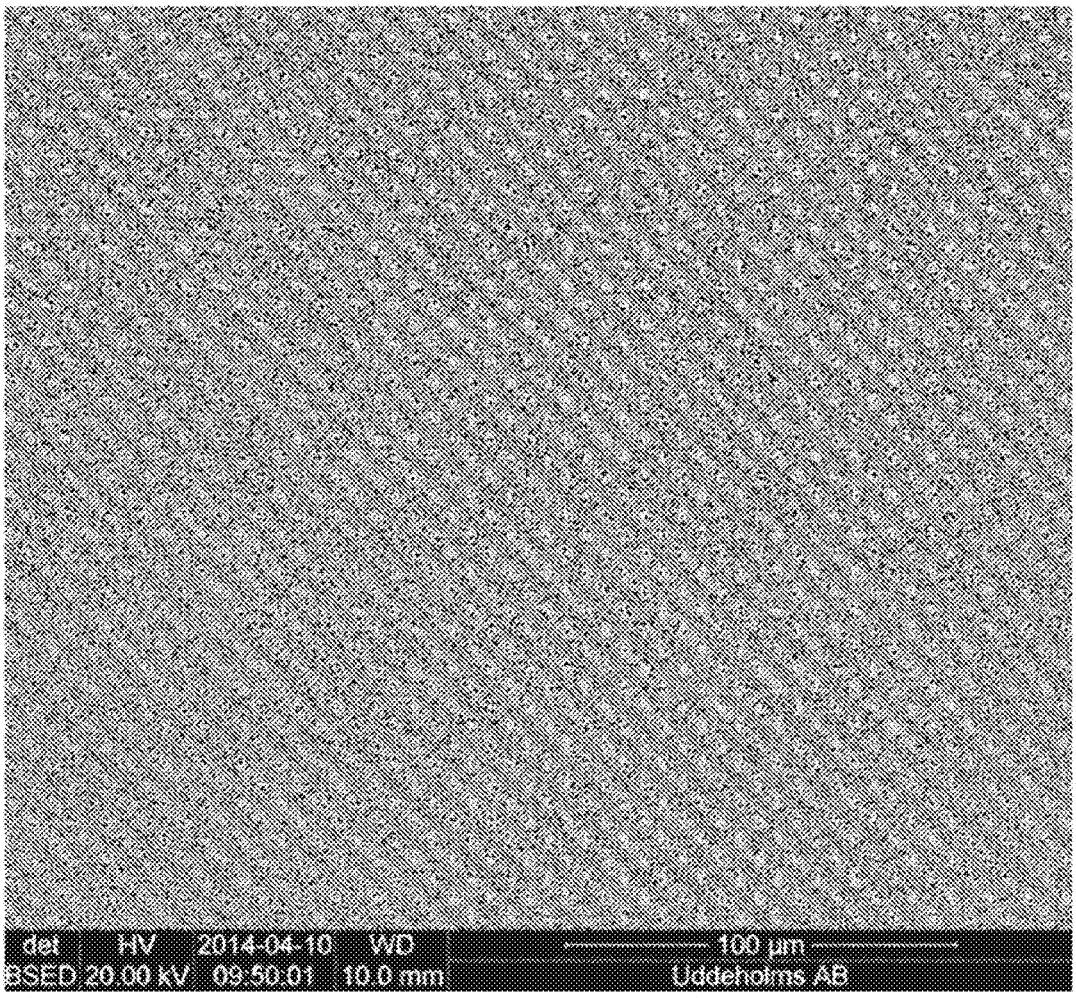
Figure 1. Microstructure of the inventive steel. Small and uniformly distributed MX-particles (black phase) in the steel matrix.

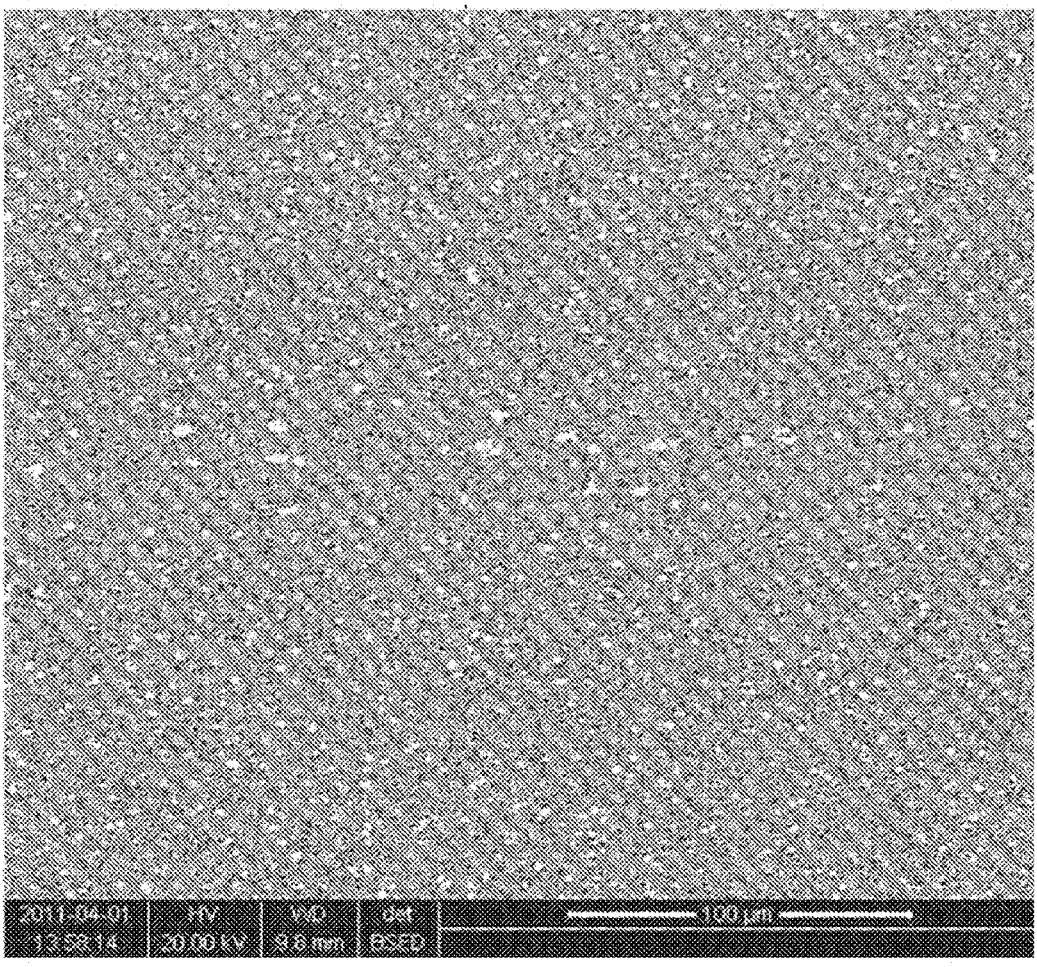
Figure 2. Microstructure of the comparative steel VANCRON®40. MX-particles (black phase) and $M_6C$-particles (white phase) in the steel matrix.

COLD WORK TOOL STEEL

CROSS-REFERENCE TO RELATED APPLICATION(S)

This is a National Stage Entry into the United States Patent and Trademark Office from International PCT Patent Application No. PCT/SE2015/050751, having an international filing date of Jun. 26, 2015, and which claims priority to European Patent Application No. EP 14177221.0, filed Jul. 16, 2014, the entire contents of both of which are incorporated herein by reference.

TECHNICAL FIELD

The invention relates to a nitrogen alloyed cold work tool steel.

BACKGROUND OF THE INVENTION

Nitrogen and vanadium alloyed powder metallurgy (PM) tool steels attained a considerable interest because of their unique combination of high hardness, high wear resistance and excellent galling resistance. These steels have a wide range of applications where the predominant failure mechanisms are adhesive wear or galling. Typical areas of application include blanking and forming, fine blanking, cold extrusion, deep drawing and powder pressing. The basic steel composition is atomized, subjected to nitrogenation and thereafter the powder is filled into a capsule and subjected to hot isostatic pressing (HIP) in order to produce an isotropic steel. A high performance steel produced in this way is VANCRON® 40. It has high carbon, nitrogen and vanadium contents and is also alloyed with substantial amounts of Cr, Mo and W, which result in a microstructure comprising hard phases of the type MX (14 vol. %) and $M_6C$ (5 vol. %). The steel is described in WO 00/79015 A1.

Although VANCRON® 40 has a very attractive property profile there is a continuous strive for improvements of the tool material in order to further improve the surface quality of the products produced as well as to extend the tool life, in particular under severe working conditions, where galling is the main problem.

BRIEF DESCRIPTION OF THE DRAWINGS

FIG. 1 depicts the microstructure of the steel of the present invention; and FIG. 2 depicts the microstructure of a comparative steel, identified as VANCRON® 40.

DISCLOSURE OF THE INVENTION

The object of the present invention is to provide a nitrogen alloyed powder metallurgy (PM) produced cold work tool steel having an improved property profile for advanced cold working.

Another object of the present invention is to provide a powder metallurgy (PM) produced cold work tool steel having a composition and microstructure leading to improvements in the surface quality of the produced parts.

The foregoing objects, as well as additional advantages are achieved to a significant measure by providing a cold work tool steel having a composition as set out in the claims.

The invention is defined in the claims.

DETAILED DESCRIPTION

The importance of the separate elements and their interaction with each other as well as the limitations of the chemical ingredients of the claimed alloy are briefly explained in the following. All percentages for the chemical composition of the steel are given in weight % (wt. %) throughout the description. The upper and lower limits of the individual elements may be freely combined within the limits set out in claim 1.

Carbon (0.5-2.1%)

Carbon is to be present in a minimum content of 0.5%, preferably at least 1.0%. The upper limit for carbon may be set to 1.8% or 2.1%. Preferred ranges include 0.8-1.6%, 1.0-1.4% and 1.25-1.35%. Carbon is important for the formation of the MX and for the hardening, where the metal M is mainly V but Mo, Cr and W may also be present. X is one or more of C, N and B. Preferably, the carbon content is adjusted in order to obtain 0.4-0.6% C dissolved in the matrix at the austenitizing temperature. In any case, the amount of carbon should he controlled such that the amount of carbides of the type $M_{23}C_6$, $M_7C_3$ and $M_6C$ in the steel is limited, preferably the steel is free from said carbides.

Nitrogen (1.3-3.5%)

Nitrogen is in the present invention essential for the formation of the hard carbonitrides of the MX-type. Nitrogen should therefore be present in an amount of at least 1.3%. The lower limit may be 1.4%, 1.5%, 1.6%, 1.7%, 1.8%, 1.9%, 2.0% 2.1% or even 2.2%. The upper limit is 3.5% and it may be set to 3.3%, 3.2%, 3.0%, 2.8%, 2.6%, 2.4%, 2.2%, 2.1% 1.9% or 1.7%. Preferred ranges include 1.6-2.1 and 1.7-1.9%.

Chromium (2.5-5.5%)

Chromium is to be present in a content of at least 2.5% in order to provide a sufficient hardenability. Cr is preferably higher for providing a good hardenability in large cross sections during heat treatment. If the chromium content is too high, this may lead to the formation of undesired carbides, such as $M_7C_3$. In addition, this may also increase the propensity of retained austenite in the microstructure. The lower limit may be 2.8%, 3.0%, 3.2%, 3.4%, 3.6%, 3.8%, 4.0%, 4.2%, 4.35%, 4.4% or 4.6%. The upper limit may be 5.2%, 5.0%, 4.9%, 4.8% or 4.65%. The chromium content is preferably 4.2-4.8%.

Molybdenum (0.8-2.2%)

Mo is known to have a very favourable effect on the hardenability. Molybdenum is essential for attaining a good secondary hardening response. The minimum content is 0.8%, and may be set to 1%, 1.25%, 1.5%, 1.6%, 1.65% or 1.8%. Molybdenum is a strong carbide-forming element. However, molybdenum is also a strong ferrite former. Mo needs to be restricted also for the reason of limiting the amount of other hard phases than MX. In particular the amount of $M_6C$-carbides should be limited, preferably to ≤3 vol. %. Most preferably no $M_6C$-carbides should be present in the microstructure. The maximum content of molybdenum is therefore 2.2%. Preferably Mo is limited to 2.15%, 2.1%, 2.0% or 1.9%.

Tungsten (≤1%)

The effect of tungsten is similar to that of Mo. However, for attaining the same effect it is necessary to add twice as much W as Mo on a weight % basis. Tungsten is expensive and it also complicates the handling of scrap metal. Like Mo, W is also forming $M_6C$-carbides. The maximum amount is therefore limited to 1%, preferably 0.5%, more preferably 0.3% and most preferably W is not deliberately added at all. By not adding W and restricting Mo, as set out above, make it possible to completely avoid the formation of $M_6C$-carbides.

Vanadium (6-18%)

Vanadium forms evenly distributed primary precipitated carbides and carbonitrides of the type MX. The precipitates may be represented by the formula M(N,C) and they are commonly also called nitrocarbides, because of the high nitrogen content. In the inventive steel M is mainly vanadium but Cr and Mo may be present to some extent. Vanadium shall be present in an amount of 6-18% in order to get the desired amount of MX. The upper limit may be set to 16%, 15%, 14%, 13%, 12%, 11%, 10,25%, 10% or 9%. The lower limit may be 7%, 8%, 8.5%, 9%, 9.75%, 10%, 11% or 12%. Preferred ranges include 8-14%, 8.5-11.0% and 9.75-10.25%.

Niobium (≤2%)

Niobium is similar to vanadium in that it forms MX or carbonitrides of the type M(N,C). However, Nb results in a more angular shape of the M(N,C). Hence, the maximum addition of Nb is restricted to 2.0% and the preferred maximum amount is 0.5%. Preferably, no niobium is added.

Silicon (0.05-1.2%)

Silicon is used for deoxidation. Si also increases the carbon activity and is beneficial for the machinability. Si is therefore present in an amount of 0.05-1.2%. For a good deoxidation, it is preferred to adjust the Si content to at least 0.2%. The lower limit may be set to 0.3%, 0.35% or 0.4%. However, Si is a strong ferrite former and should be limited to 1.2%. The upper limit may be set to 1.1%, 1%, 0.9%, 0.8%, 0.75%, 0.7% or 0.65%. A preferred range is 0.3-0.8%.

Manganese (0.05-1.5%)

Manganese contributes to improving the hardenability of the steel and together with sulphur manganese contributes to improving the machinability by forming manganese sulphides. Manganese shall therefore be present in a minimum content of 0.05%, preferably at least 0.1 and more preferably at least 0.2%. At higher sulphur contents manganese prevents red brittleness in the steel. The steel shall contain maximum 1.5% Mn. The upper limit may be set to 1.4%, 1.3%, 1.2%, 1.1%, 1.0%, 0.9%, 0.8%, 0.7%, 0.7% 0.6% or 0.5%. However, preferred ranges are 0.2-0.9%, 0.2-0.6 and 0.3-0.5%.

Nickel (≤3.0%)

Nickel is optional and may be present in an amount of up to 3%. It gives the steel a good hardenability and toughness. Because of the expense, the nickel content of the steel should be limited as far as possible. Accordingly, the Ni content is limited to 1%, preferably 0.3%. Most preferably, no nickel additions are made.

Copper (≤3.0%)

Cu is an optional element, which may contribute to increasing the hardness and the corrosion resistance of the steel. If used, the preferred range is 0.02-2% and the most preferred range is 0.04-1.6%. However, it is not possible to extract copper from the steel once it has been added. This drastically makes the scrap handling more difficult. For this reason, copper is normally not deliberately added.

Cobalt (≤12%)

Co is an optional element. Co dissolves in iron (ferrite and austenite) and strengthens it whilst at the same time imparting high temperature strength. Co increases the $M_5$ temperature. During solution heat treatment Co helps to resist grain growth so that higher solution temperatures can be used which ensures a higher percentage of carbides being dissolved resulting in an improved secondary hardening response. Co also delays the coalescence of the carbides and carbonitrides and tends to cause secondary hardening to occur at higher temperatures. Co contributes to increase the hardness of the martensite. The maximum amount is 12%. The upper limit may be set to 10%, 8%, 7%, 6%, 5% or 4%. The lower limit may be set to 1%, 2%, 3%, 4% or 5%. However, for practical reasons such as scrap handling there is no deliberate addition of Co. A preferred maximum content is 1%.

Phosphorous (≤0.05)

P is a solid solution strengthening element. However, P tends to segregate to the grain boundaries, reduces the cohesion and thereby the toughness. P is therefore limited to ≤0.05%.

Sulphur (≤0.5%)

S contributes to improving the machinability of the steel. At higher sulphur contents there is a risk for red brittleness. Moreover, a high sulphur content may have a negative effect on the fatigue properties of the steel. The steel shall therefore contain ≤0.5%, preferably ≤0.03%.

Be, Bi, Se, Ca, Mg, O and REM (Rare Earth Metals)

These elements may be added to the steel in the claimed amounts in order to further improve the machinability, hot workability and/or weldability of the claimed steel.

Boron (≤0.6%)

Substantial amounts of boron may optionally be used to assist in the formation of the hard phase MX. B may be used in order to increase the hardness of the steel. The amount is then limited to 0.01%, preferably ≤0.004%.

Ti, Zr, Al and Ta

These elements are carbide formers and may be present in the alloy in the claimed ranges for altering the composition of the hard phases. However, normally none of these elements are added.

Steel Production

Tool steels having the claimed chemical composition can be produced by conventional gas atomizing followed by a nitrogenation treatment. The nitrogenation may be performed by subjecting the atomized powder to an ammonia based gas mixture at 500-600° C., whereby nitrogen diffuses into the powder, reacts with vanadium and nucleate minute carbonitrides. Normally the steel is subjected to hardening and tempering before being used.

Austenitizing may be performed at an austenitizing temperature (TA) in the range of 950-1150° C., typically 1020-1080° C. A typical treatment comprises austenitizing at 1050° C. for 30 minutes, gas quenching and tempering three times at 530° C. for 1 hour followed by air cooling. This results in a hardness of 60-66 HRC.

EXAMPLE

In this example, a steel according to the invention is compared to the known steel. Both steels were produced by powder metallurgy.

The basic steel compositions were melted and subjected to gas atomization, nitrgogenation, capsuling and HIPing.

The steels thus obtained had the following compositions (in wt. %):

| | Inventive steel | VANCRON ®40 |
|---|---|---|
| C | 1.3 | 1.2 |
| N | 1.8 | 1.8 |
| Si | 0.5 | 0.5 |
| Mn | 0.4 | 0.4 |
| Cr | 4.5 | 4.6 |
| Mo | 1.8 | 3.25 |
| W | 0.1 | 3.8 |
| V | 10.0 | 8.5 |

balance iron and impurities.

The microstructure of the two steels was examined and it was found that the inventive steel contained about 20 vol. % MX (black phase), which particles are small in size and uniformly distributed within the matrix as disclosed in FIG. 1.

The comparative steel on the other hand contained about 15 vol. % MX and about 6 vol. % $M_6C$ (white phase) as shown in FIG. 2. It is apparent from this figure that the $M_6C$ carbides are larger than the MX-particles and that there is a certain spread in the particle size distribution of the $M_6C$ carbides.

The steels were austenitized at 1050° C. for 30 minutes and hardened by gas quenching and tempering at 550° C. for 1 hour (3×1 h) followed by air cooling. This resulted in a hardness of 63 FIRC for the inventive steel and 62 HRC for the comparative material. The equilibrium composition of the matrix and the amount of primary MX and $M_6C$ at the austenitizing temperature (1050° C.) were calculated in a Thermo-Calc simulation with the software version S-build-2532 and the database TCFE6. The calculations showed that the inventive steel was free from $M_6C$-carbides and contained 16.3 vol. % MX. The comparative steel on the other hand was found to contain 5.2 vol. % $M_6C$ and 14.3 vol. % MX.

The two materials were used in rolls for cold rolling of stainless steel and it was found that the inventive material resulted in an improved surface micro-roughness of the cold rolled steel, which may be attributed to the more uniform microstructure and to the absence of the large $M_6C$-carbides.

INDUSTRIAL APPLICABILITY

The cold work tool steel of the present invention is particular useful in applications requiring very high galling resistance such as blanking and forming of austenitic stainless steel, The small size of the MX-carbonitrides in combination with their uniform distribution is also expected to result in an improved galling resistance.

The invention claimed is:

1. A steel for cold working, consisting of, in weight %:
C 0.5-2.1
N 1.3-3.5
Si 0.05-1.2
Mn 0.05-1.5
Cr 2.5-5.5
Mo 0.8-2.0
V 6-18
W ≤0.40
optionally one or more of
P ≤0.05
S ≤0.5
Cu ≤3
Co ≤12
Ni ≤3
Nb ≤2
Ti ≤0.1
Zr ≤0.1
Ta ≤0.1
B ≤0.6
Be ≤0.2
Bi ≤0.2
Se ≤0.3
Ca 0.0003-0.009
Mg ≤0.01
REM ≤0.2
balance Fe apart from impurities, and
wherein the steel has a microstructure including carbides and carbonitrides, in volume %, such that $M_6X \leq 3$, M is a metal, and X is one or more of C, N, and B.

2. The steel according to claim 1, fulfilling at least one of the following requirements:
C 0.6-1.8
N 1.4-3.3
Si 0.2-1.1
Mn 0.1-1.1
Cr 2.8-5.2
Mo 1.25-2.0
V 7-16
P ≤0.03
S ≤0.03
Cu 0.02-2
Co ≤1
Ni ≤1
Nb ≤1
Ti ≤0.01
Zr ≤0.01
Ta ≤0.01
B ≤0.005
Be ≤0.02
Se ≤0.03, and
Mg ≤0.001.

3. The steel according to claim 1, fulfilling at least one of the following requirements:
C 0.8-1.6
N 1.6-3.2
Si 0.25-0.85
Mn 0.2-0.9
Cr 3.2-5.0
Mo 1.5-2.0
V 8-14
Co ≤1
Cu ≤0.5
Ni ≤0.3, and
Nb ≤0.5.

4. The steel according to claim 1, fulfilling at least one of the following requirements:
C 1.0-1.4
N 1.6-2.1
Si 0.3-0.8
Mn 0.2-0.6
Cr 4.2-4.8
Mo 1.6-2.0, and
V 8.5-11.0.

5. The steel according to claim 1, fulfilling at least one of the following requirements:
C 1.25-1.35
N 1.7-1.9
Si 0.35-0.65
Mn 0.3-0.5
Cr 4.35-4.65
Mo 1.65-1.95
W ≤0.30, and
V 9.75-10.25.

6. The steel according to claim 1, consisting of:
C 1.0-1.4
N 1.6-2.1
Si 0.3-0.8
Mn 0.2-0.6
Cr 4.2-4.8
Mo 1.6-2.0
V 8.5-11.0, and
balance Fe apart from impurities.

7. The steel according to claim 1, wherein carbides and carbonitrides fulfill the following requirements in volume %:
MX 15-35
$M_7X_3 \leq 1$
$M_{23}X_6 \leq 1$, and
wherein M is a one or more of V, Cr and Mo.

8. The steel according to claim 7, fulfilling the requirement:

MX 5-30

$M_6X \leq 1$ $M_7X_3 \leq 0.2$, and $M_{23}X_6 \leq 0.2$.

9. The steel according to claim 1, wherein carbides and carbonitrides fulfill the following requirements, in volume %:

MX 15-30

$M_6X \leq 0.1$, and wherein a microstructure is free from $M_7X_3$ and $M_{23}X_6$.

10. The steel according to claim 9, wherein the microstructure is free from $M_6X$.

11. The steel according to claim 1, wherein the Equivalent Circle Diameter (ECD) of the carbides and carbonitrides in a microstructure is less than 1.5 μm.

12. The steel according to claim 11, wherein the ECD of the carbides and carbonitrides in the microstructure is less than 1.0 μm.

* * * * *